United States Patent [19]

Gagliano

[11] Patent Number: 5,039,256

[45] Date of Patent: Aug. 13, 1991

[54] PINNED FOUNDATION SYSTEM

[76] Inventor: Richard Gagliano, 5004 Puget Blvd., SW., Seattle, Wash. 98106

[21] Appl. No.: 493,996

[22] Filed: Mar. 15, 1990

[51] Int. Cl.[5] ..... E02D 5/00

[52] U.S. Cl. ..... 405/244; 405/229; 405/233

[58] Field of Search ..... 405/227, 229, 233, 239, 405/244, 257; 52/155, 158, 724, 725; 249/1, 10, 51

[56] References Cited

U.S. PATENT DOCUMENTS

| | | | |
|---|---|---|---|
| 979,474 | 12/1910 | Goldsborough | 405/229 |
| 1,238,384 | 8/1917 | Blumenthal | 249/1 X |
| 1,407,196 | 2/1922 | Johnson | 249/51 |
| 1,762,341 | 6/1930 | McPherson | 405/244 X |
| 1,808,633 | 6/1931 | Carver | 52/158 |
| 2,826,281 | 3/1958 | Johnson | 52/158 |
| 2,964,145 | 12/1960 | Clatfelter | 52/158 |
| 4,767,241 | 8/1988 | Wells | 405/239 |

FOREIGN PATENT DOCUMENTS

| | | | |
|---|---|---|---|
| 665988 | 10/1938 | Fed. Rep. of Germany | 405/229 |
| 1080764 | 12/1954 | France | 405/229 |
| 243956 | 12/1925 | United Kingdom | 405/229 |

*Primary Examiner*—David H. Corbin

*Attorney, Agent, or Firm*—Hopgood, Calimafde, Kalil, Blaustein & Judlowe

[57] ABSTRACT

A pinned foundation system with resiliency under certain loading conditions and requiring minimum excavation, having a cast footing in combination with a plurality of sleeves through which piles may be driven into the soil to create the necessary bearing, uplift and lateral forces to support a structure. The sleeves are retained in fixed position relative to the footing, at predetermined angles corresponding to the specific structure loading characteristics desired for the ensuing foundation.

22 Claims, 8 Drawing Sheets

PINNED FOUNDATION SYSTEM

The present invention generally relates to apparatus and methods for the support of surface structures. More specifically, the present invention relates to a standardized series of preformed, engineered guides to create minimally intrusive, resilient foundation systems supportive for both distributed and concentrated load conditions of primary gravity and secondary lateral and uplift forces.

BACKGROUND OF THE INVENTION

The construction of surface structures invariably involves the preliminary task of building a foundation to support the structure. As population growth and demographic shifts continue to generate construction in the peripheries of developed areas, foundations are built on previously undisturbed or undesirable building sites, often containing expansive soils or having poor slope and drainage characteristics. The manipulation of these sites to accommodate typical foundations for new structures and/or the adaptation of these foundations to meet more demanding site and soil conditions raise considerably the costs of equipment, materials, labor, and where possible environment renewal.

The effects of site manipulation on undisturbed soil are permanent and not restricted to the individual sites on which they occur. "Improving" a site with the use of large machinery, extensive excavation and fill techniques, and the altering of drainage patterns and water tables damages the chemical balance and structural integrity of the specific and surrounding soils. Exaggerated by this damage, sustained shifting, soil expansion and contraction, and sudden soil movements, can cause cracking and weakening of newly built, neighboring or to be built, often brittle foundations. Measures to prevent foundation failure currently involve more digging, more fill, and the construction of larger, heavier foundations. Even as these efforts are taken the frequency and cost of foundation repair is steadily rising.

Innovations in foundation design and construction in these undesirable soils must consider low environmental impact, economical construction, and the use of techniques with the potential for fresh expression and resilient adaptation above ground. As it becomes necessary to activate typically undesirable building sites, the traditional methods for supporting our dwellings are becoming more inappropriate.

The present invention was developed and is in response to the significant shortcomings in current designs and methods to provide structure foundations.

OBJECTS AND SUMMARY OF THE INVENTION

An object of this invention is to provide a new method for constructing structure foundations which is applicable to a wide variety of site and soil conditions.

Another object of this invention is to provide a foundation which is applicable for uniformly or non-uniformly distributed bearing conditions, and concentrated or point bearing conditions.

Another object of this invention is to provide a system for a foundation which is resilient to a degree of prolonged and/or sudden soil movement.

It is also an object of this invention to provide a foundation system which reinforces the soil which it engages.

A further object of this invention is to provide a method for constructing a foundation system which requires substantially less resources than current methods.

A further object of this invention is to provide a method for constructing a foundation system which will require substantially less site excavation for above grade buildings.

A further object of this invention is to provide a method of constructing a foundation system without damaging or altering the moisture content, drainage characteristics, chemical make-up or structural integrity of the soil which it engages.

It is also an object of this invention to provide a foundation system which is removable and reusable and has some replaceable parts.

It is also an object of this invention to provide a foundation system which can be applied repeatedly, through the use of any one embodiment or combination of embodiments from a group of preformed, pre-engineered guides, as standardized construction components with a specific load bearing capacity, maintenance schedule and structural function.

The above and other objects of the present invention are realized in two foundation system modes—one supportive of distributed loads, and the other supportive of concentrated loads. Both modes are comprised of five basic components which in a variety of specific configurations form a hybridized foundation system combining driven pile and formed footing technologies. In preparing either system mode a standard, pre-engineered form, providing a mold for a cementitious material, and containing sleeves for the guiding of obliquely driven piles is set within a minimal excavation. Piles are then driven through the sleeves at angles and to depths determined by specific loading criteria, and the cementitious material is set within the containing form, around the pile sleeves housing the upper ends of the driven piles. The cementitious material can also be precast with the sleeve in place and then installed. The base of the surface structure is then attached to the cured cementitious material using any appropriate conventional connection method. The surface structure, once attached, will rest directly on the formed foundation. The sum of all the surface areas along the lengths and of the ends of all the obliquely driven piles, combined with the total surface area of the base of the cured cementitious material provides the overall loading area upon which the capacity of the systems are based. More specifically, the pile guide, driven piles and cementitious material act in concert to create a multiple load foundation with minimal intrusion into the ground.

The grouping of obliquely driven piles in specific, geometric configurations and their relationship to the cementitious footing is integral to the capacity of either system mode to resist vertical loads. Typically, obliquely driven piles are used only to resist lateral loading. The present invention ensures, with the use of specifically delineated reinforcing elements, or pile retainers engaging the group or groups of pile sleeves, that the given number of driven piles in a group act in concert and in conjunction with the cementitious footing, and that under loading, their specific geometric configuration remains fixed, allowing the piles to resist, in addition to lateral loads, both gravitational and uplifting forces.

Also, the obliquely driven piles in their specific configurations engage the soil to the side or sides of the cementitious footing, providing soil reinforcement, limiting that soil's potential to bulge outward and upward under loading, and thereby increasing the system's overall capacity. Finally, the use of replaceable, resilient, driven piles which share the bearing load with the more brittle footing allows either system to sustain a degree of sudden or prolonged soil movement without its loading capacity being significantly diminished.

The foregoing features of the present invention is more fully described from the following detailed discussion of a specific illustrative embodiment thereof, presented hereinbelow in conjunction with the accompanying drawings:

DETAILED DESCRIPTION OF THE PREFERRED EMBODIMENTS

First briefly in overview, the present invention is directed to a structural combination that uniquely combines driven piles and formed footing technologies to provide a foundation for surface structures. This system distributes significant surface loads to the supporting soil without the need for an extensive site excavation. In the following discussion of the drawings, like numerals are used to indicate common elements provided in the various views.

Figure 1:
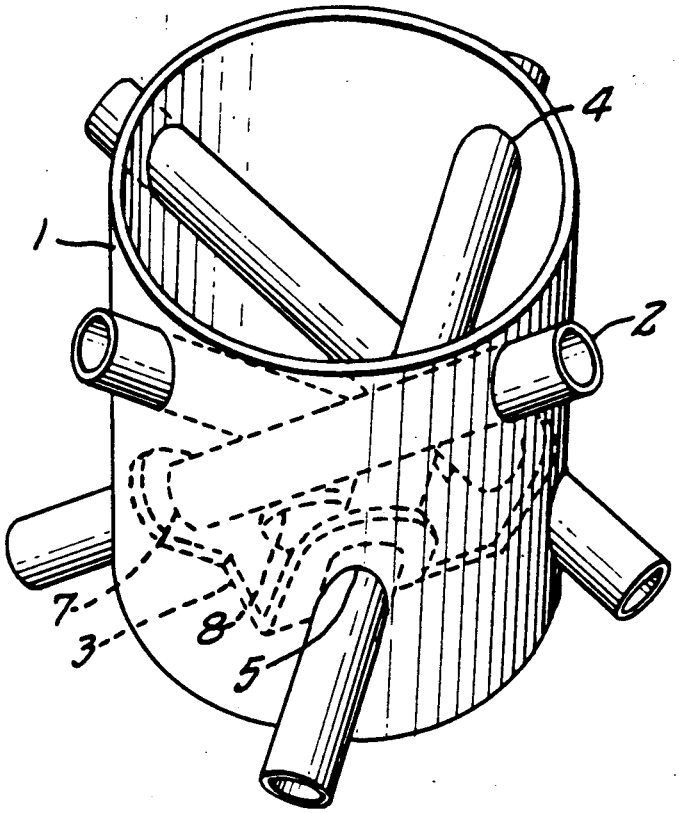
FIG. 1 is a perspective view of the foundation guide of the present invention.

Referring now to FIG. 1, a cylindrical form 1 open at both ends is provided with four guide sleeves 2 located symmetrically around the perimeter of a tension plate 3 and passing through the form 1, via corresponding entry and exit openings in the form 1. Each guide sleeve 2, passes through the form 1 from the point of entry 4 proximate to the top of the form 1, through the tension plate 3, and out at the point of exit 5 near the bottom of the form 1.

The position of the openings in Form 1 determines the angle of the guide sleeve relative to the form. This angle will preferably vary between 30° and 70° from vertical; a 45° pitch is a representative incline and suitable for illustrative purposes.

Figure 2:
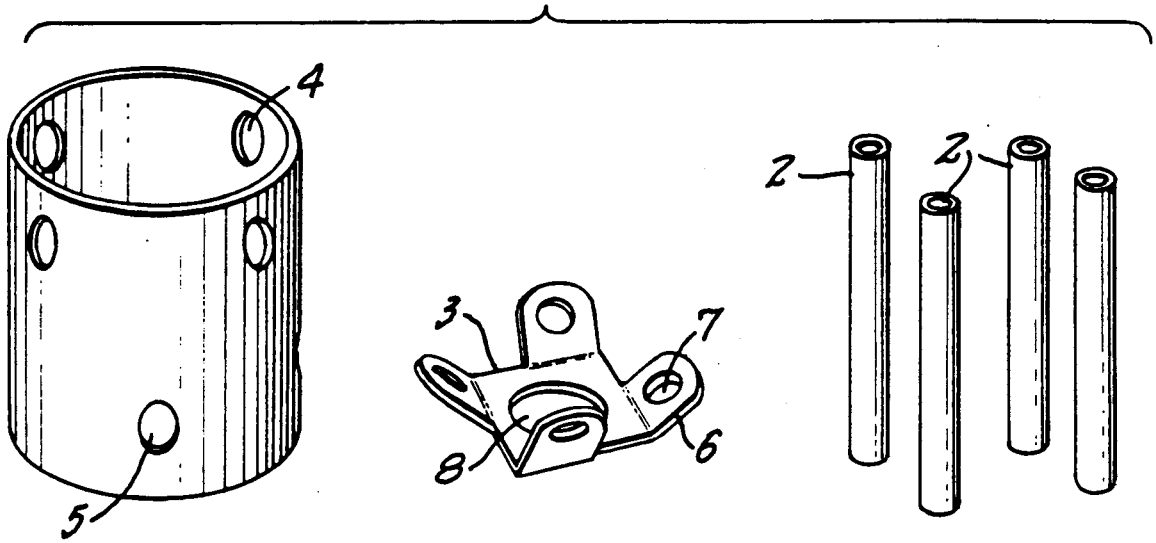
FIG. 2 is a perspective view of the components of the guide system in FIG. 1.

As depicted in FIG. 2, the foundation guide presented in FIG. 1 comprises several distinct components. The form 1 may consist of a hollow column which is circular, rectangular or triangular in shape. The form may be molded or fabricated of material adaptable to use with a pile foundation. The form functions as a mold for the footing or base which is created by pouring concrete or similar casting material into the form and may also provide additional attachment points for the guide sleeves. In the preferred embodiment as shown in FIG. 2, the form is an open ended cylinder made of dense pressed cardboard. Alternatively, this form can be created by the excavated area itself. In this way, the form provides a receptacle for the pouring and subsequent curing of a cementitious material establishing the base.

The tension plate 3 may be of material suitable for use in retaining the guides within the confines of the form 1. The tension plate 3 fixedly holds the plural guides in their predetermined location relative to the form. The tension plate acts to retain the shape of the cast footing and prevent spreading of the piles under load. In the preferred embodiment as shown in FIG. 2, the tension plate 3 is galvanized steel. There is a tongue extension 6 for each sleeve opening 7 cut in the tension plate 3. The tension plate has a center opening 8 which allows for more complete flow of the cementitious material in the form. The tension plate 3 also allows the passage of the guide sleeves 2 without play, through the form 1.

Pursuant to the above defined functions of the tension plate, its location is typically within the confines of the form for the cementitious material. In some installations involving a less corrosive environment, the tension plate or equivalent thereof can be applied external to the form. More particularly, steel bands can be wrapped externally about the form with attachment points for engaging the sleeve guides. This option may also be available by application of corrosive resistant alloys in the tension plate.

The guide sleeves 2 are shaped and configured to guide the piles into the surrounding soil, and therefore are constructed of a substantially rigid material. The guide sleeve 2 acts to hold the pile in position at an angle relative to the form 1; this can be accomplished by using steel tubes, although aluminum, galvanized metal and some polymers can be substituted. In fact, some corrosive environments will be better addressed by the use of a rigid thermoplastic for the sleeves.

Differing system configurations, soil conditions and structural functions dictate specific angular relationships between the piles and form in addition to their respective size. In general, increasing the diameter and number of piles increases their supportive capacity, as does enlarging the "in contact" surface area, or altering the shape of the cementitious body. This coupled with adjustments to the angle at which the piles are driven permits control of the specific load capacity of the overall system.

Figure 3:
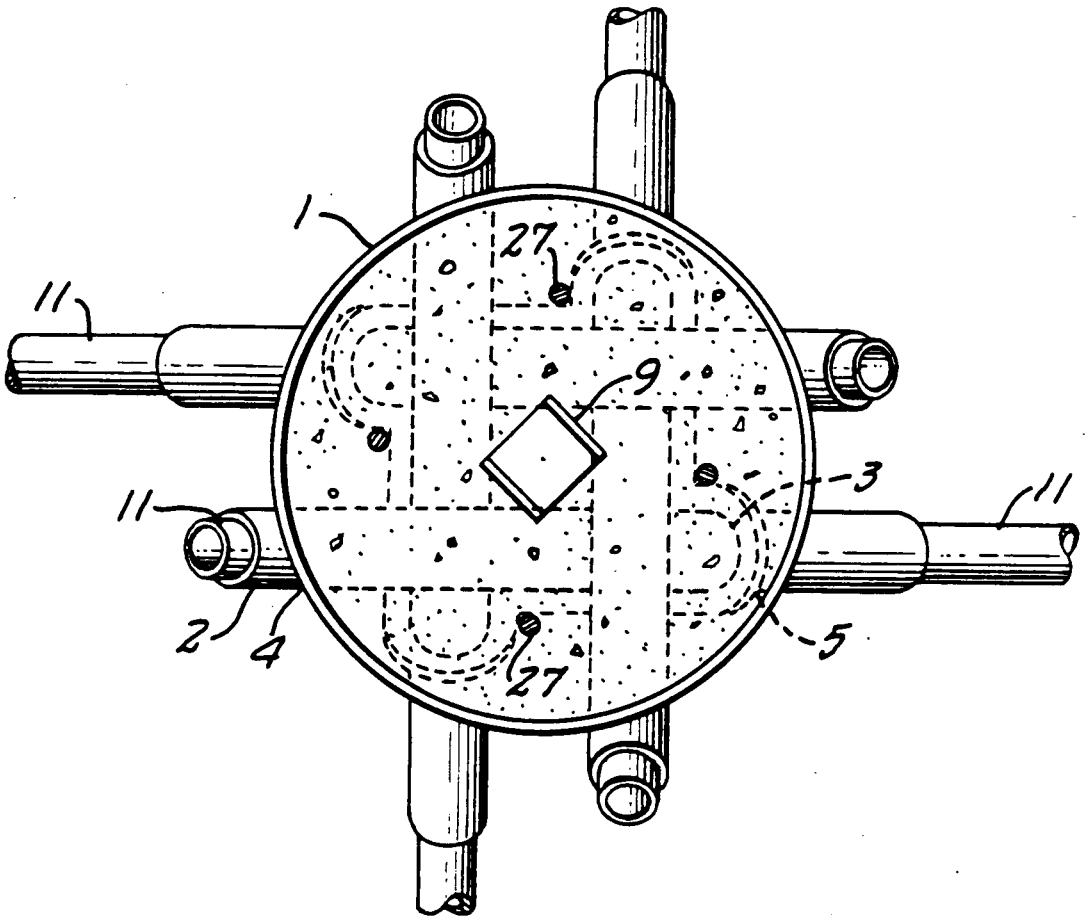
FIG. 3 is a top view of the guide in FIG. 1 with poured cementitious material.

In application, the foundation guide presented in FIG. 1 (first embodiment) is assembled for field installation as reflected in the top view provided in FIG. 3. In this view, cylindrical form 1 houses the active elements of the system which are securely positioned by cement or similar material. More particularly, it can be seen that four separate guide sleeves 2 pass through the side wall of the form. The position of these four guide sleeves is retained by tension plate 3, via plate openings 7 corresponding to each guide sleeve.

Figure 4:
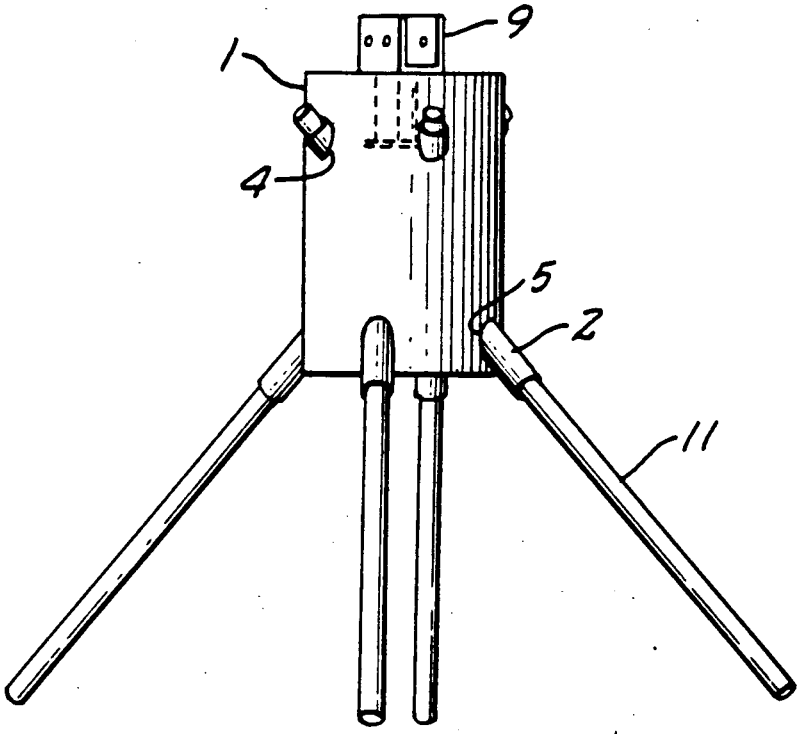
FIG. 4 is a side view of the guide in FIG. 3 with installed piles.

The internal structure of form 1 is further fixed by filling the remaining voids therein with cement or concrete and optionally placing reinforcing rods 27 prior to curing. Importantly, bracket 9 is embedded into the cement in the form for subsequent connection to the above surface structure. Piles 11 pass through the guide sleeves and extend for a significant distance into the surrounding soil. This arrangement of elements can be more fully appreciated by the side view presented in FIG. 4. This Figure provides a clear presentation of the positions of bracket 9 and piles 11 relative to the foundation guide. In this regard, bracket 9 can be any appropriate connective element for securing the foundation to the structure. As shown, the piles 11 are hollow pipes normally capped; these may be optionally filled with cement, or other material. Alternatively, solid steel piles or other alloys, hollow or solid may be used as determined by the particular location.

Figure 5:
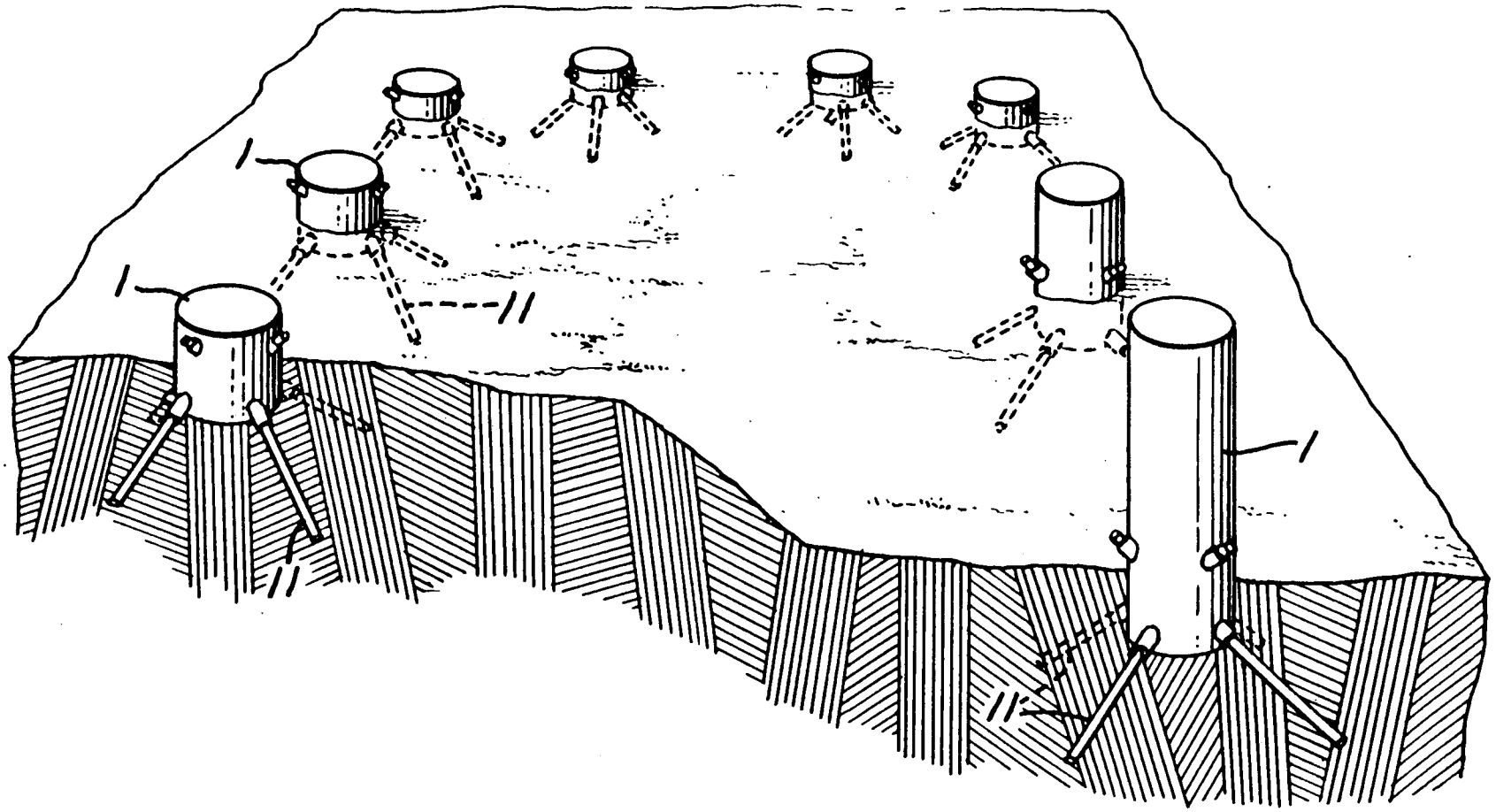
FIG. 5 is a perspective view of a perimeter foundation established by a series of installed guides.

To support a complex structure such as a building, the foundation guide of the first embodiment is deployed in the manner reflected in FIG. 5 creating the desired foundation system. More particularly, individual foundation guides are placed in discretely prepared shallow holes forming a foundation perimeter that corresponds to the floor dimensions of the ensuing structure. These guides are held into position by the piles 11 that penetrate a significant distance into the soil. In this particular diagram, the guides have form elements varying in height. In this manner, the perimeter foundation system can provide a level foundation on sloping terrain. A taller form will often require more reinforcement, via reinforcing rods 27.

Second Embodiment

Figure 6:
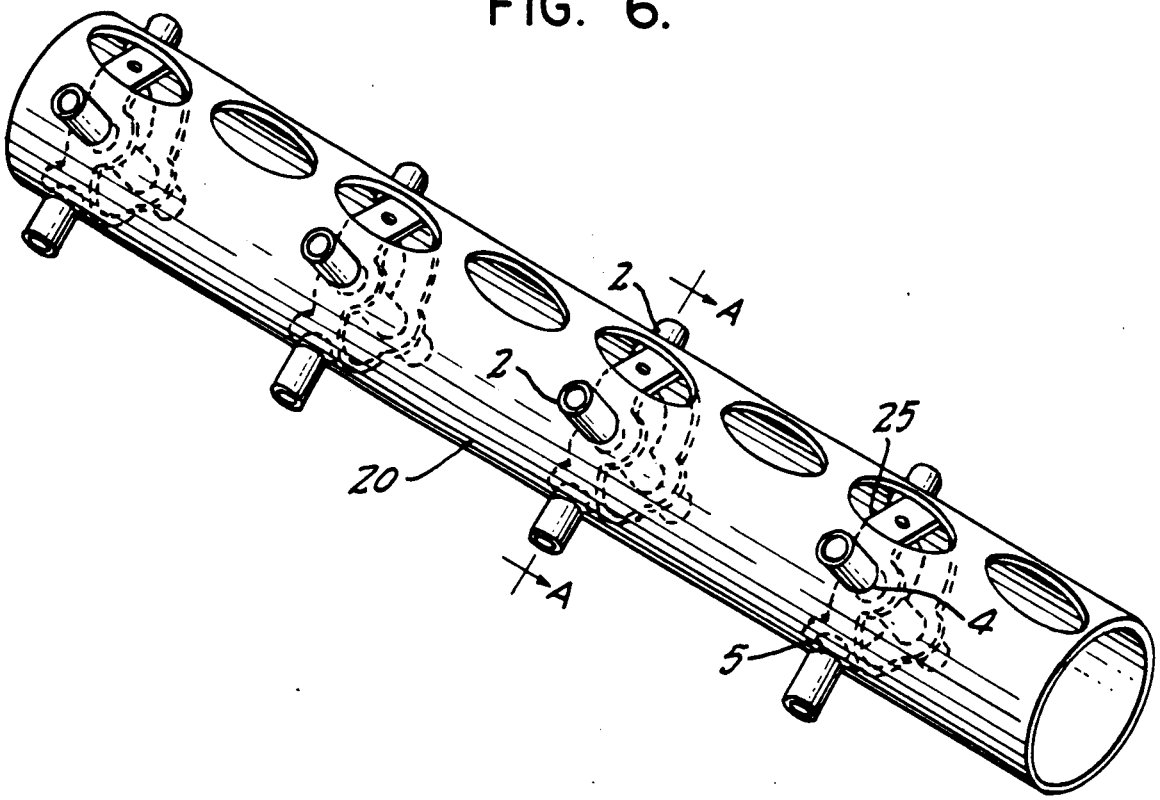
FIG. 6 is a perspective view of another embodiment of a foundation guide.
Figure 7:
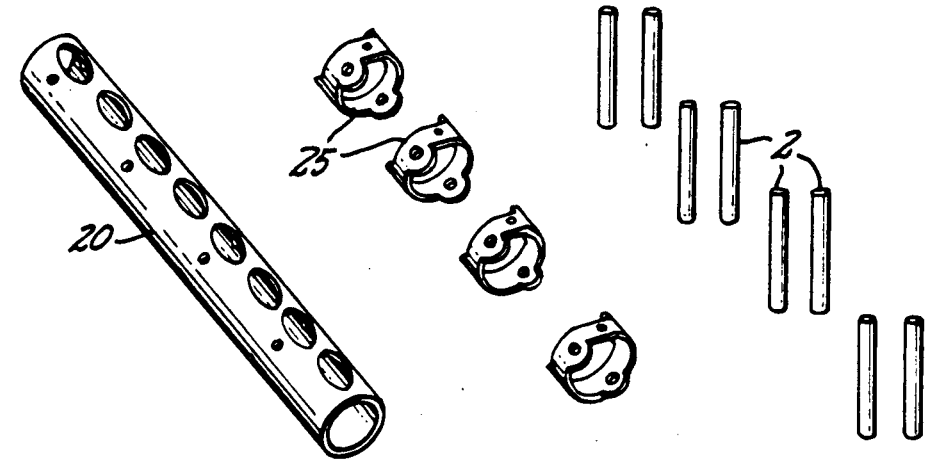
FIG. 7 is a perspective view of the components of a foundation guide in FIG. 6.

As presented in FIG. 6, a separate embodiment of the present invention provides a foundation support system for distributed loads. This embodiment is specifically characterized by a horizontal elongated cylindrical form 20 open at both ends and having a series of openings along the top side of the cylindrical wall. Discretely positioned within the confines of form 20 are a series of circular retention rings 25. The location of these retention rings correspond to entry 4 and outlet 5 openings in form 20 to permit the positioning of sleeves 2 at specifically delineated angles therein. The individual components presented in FIG. 6 are shown in disassembled form in FIG. 7.

Figure 10:
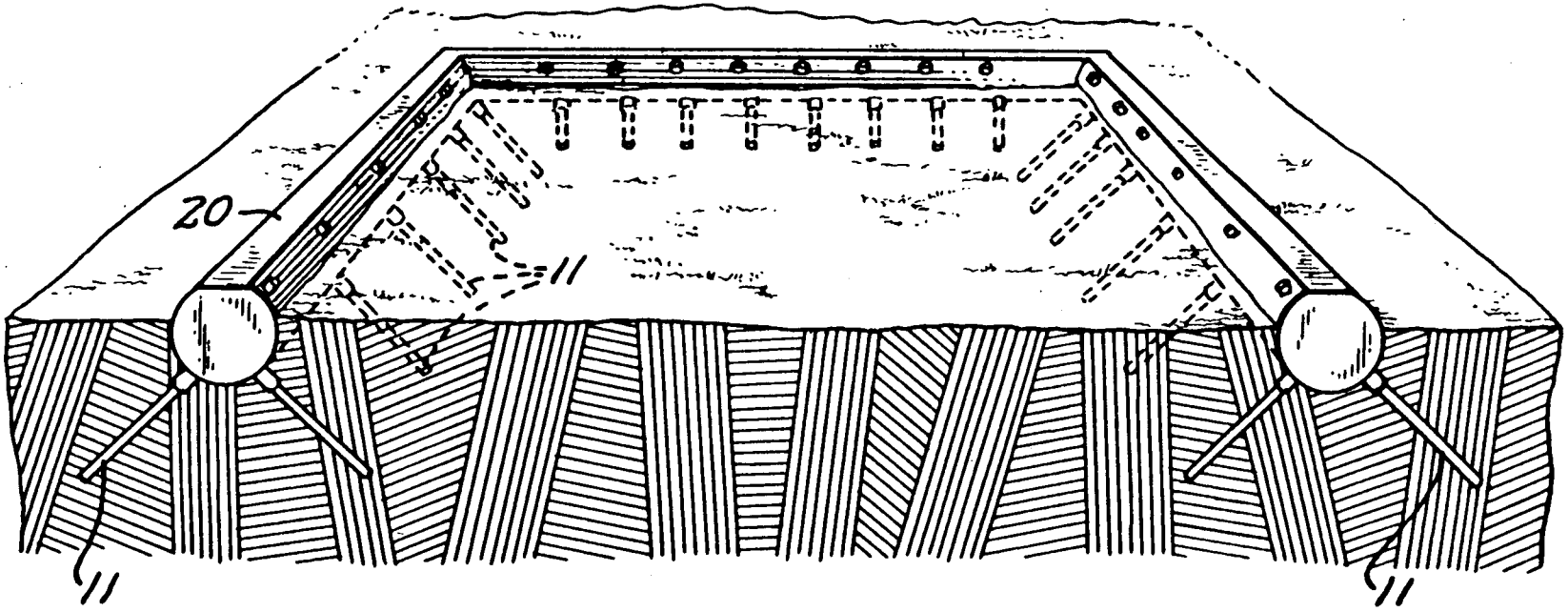
FIG. 10 is a perspective view of an installed guide foundation system using the guide of FIG. 6 to form a perimeter foundation.

In application, this embodiment is deployed in a shallow trench. This can be more clearly appreciated by referring to FIG. 10, wherein a perimeter foundation structure (showing three sides thereof) is provided. This particular foundation uses a single form for each side of the foundation.

Figure 8:
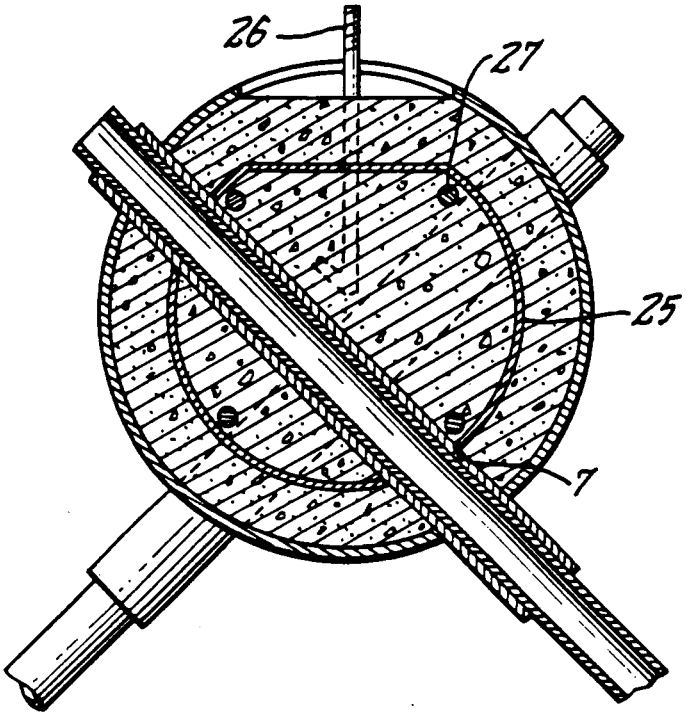
FIG. 8 is cross-sectional view A-A of the foundation guide in FIG. 6 with poured cementitious material.

In a manner analogous to that applied in the first embodiment, the form 20 shown in FIG. 6 is filled with cement or similar material and piles are driven through the guides and held in fixed position by the composite structure therein, forming a long footing. This can be more clearly seen in the cross-sectional view provided in FIG. 8 (Section A—A from FIG. 6). Reinforcing rods 27 may also be positioned within the form 20 to give the total structure additional strength.

Figure 9:
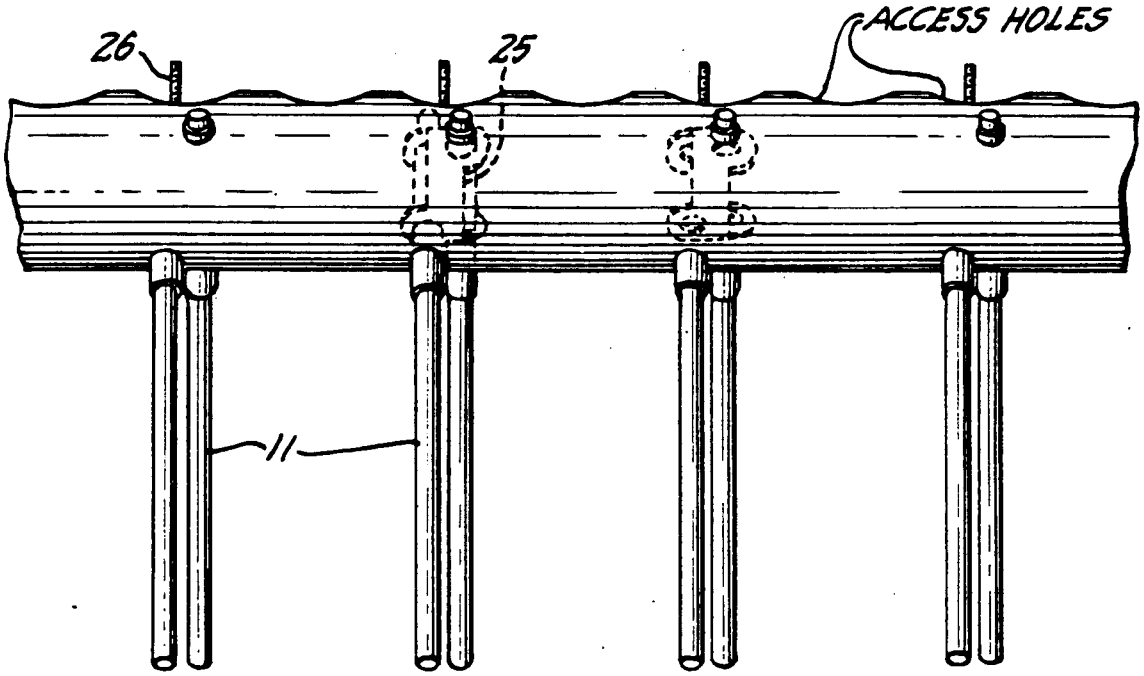
FIG. 9 is a side view of the guide in FIG. 6, with the poured cementitious material and installed piles.

The operative aspects of this arrangement can be more fully appreciated in view of the assembly provided in FIG. 9, wherein attachment points (e.g., anchor bolts) 26 extend out from the top surface of the footing created by form 20, and piles 11 extend outward a significant distance from the guide at angles defined by the relative location of the tension ring and sleeve opening 7 therein.

Figure 11:
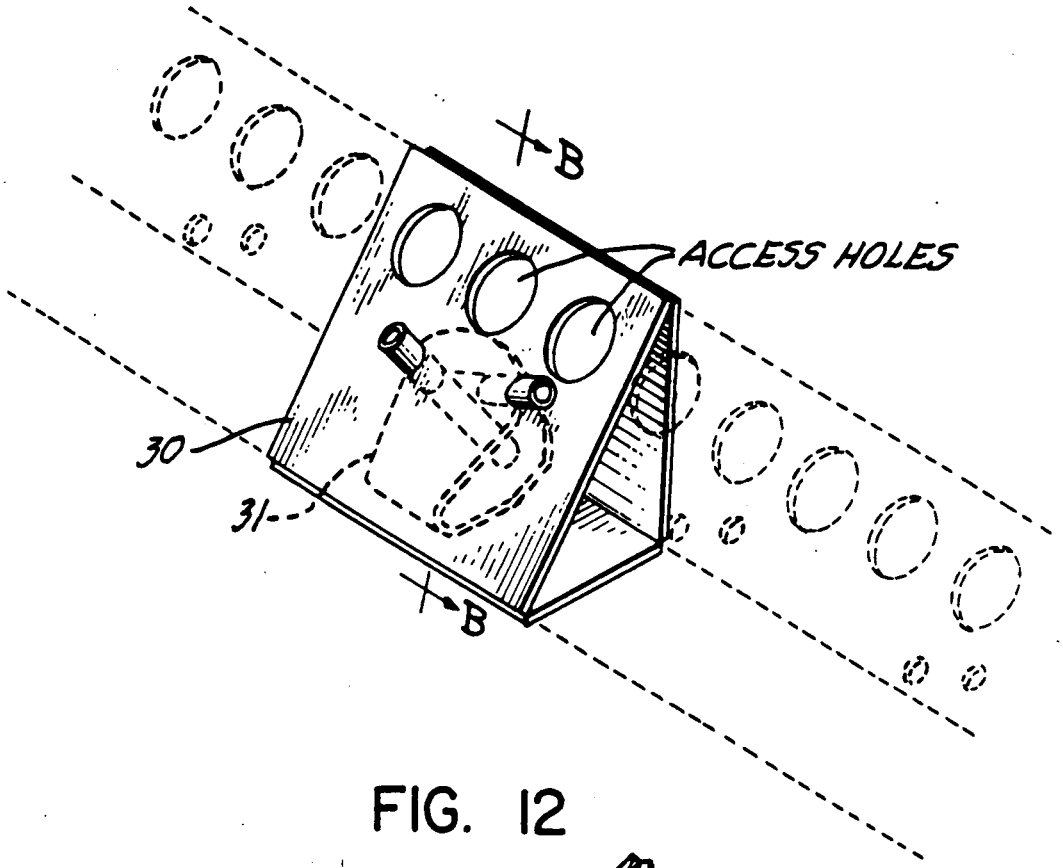
FIG. 11 is a related embodiment of the guides in FIGS. 1 and 6.
Figure 12:
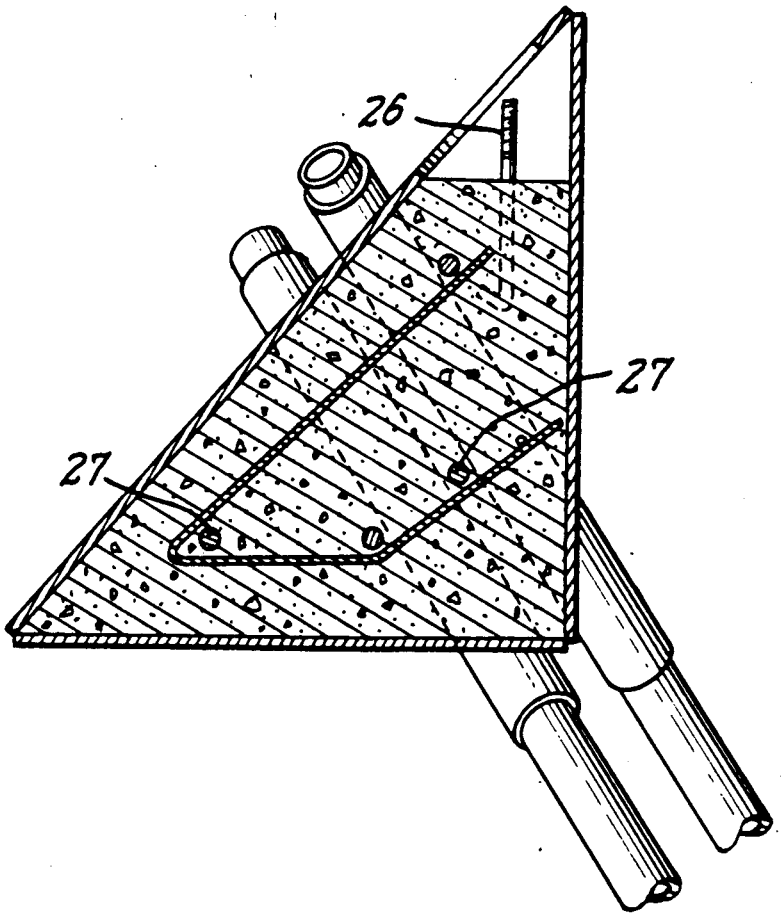
FIG. 12 is cross-sectional view B—B of the depicted in FIG. 11.

In the preceding discussion, two separate embodiments of the present invention have been presented and discussed in detail. The first embodiment focuses on a foundation guide structure designed for concentrated load support, while the second embodiment is directed to a guide system for a support of distributed loads. In FIG. 11, a separate geometry is provided that is applicable to both concentrated load support (the structure defined by the solid lines) or distributed load support (an elongated structure defined by the broken lines in conjunction with the solid structure shown). The guide shown in FIG. 11 has a form 30, with a triangular cross-section (see cross-section B—B as depicted in FIG. 12). The internal tension bracket 31 is configured to direct the supporting piles into the soil on the same side relative to the form 30. This asymmetrical arrangement permits the supplemental support of an existing foundation wall that is otherwise suffering degradation or collapse. In addition, this arrangement is applicable to new construction for floor systems using poured slab or framed minimal crawl space designs.

Figure 13:
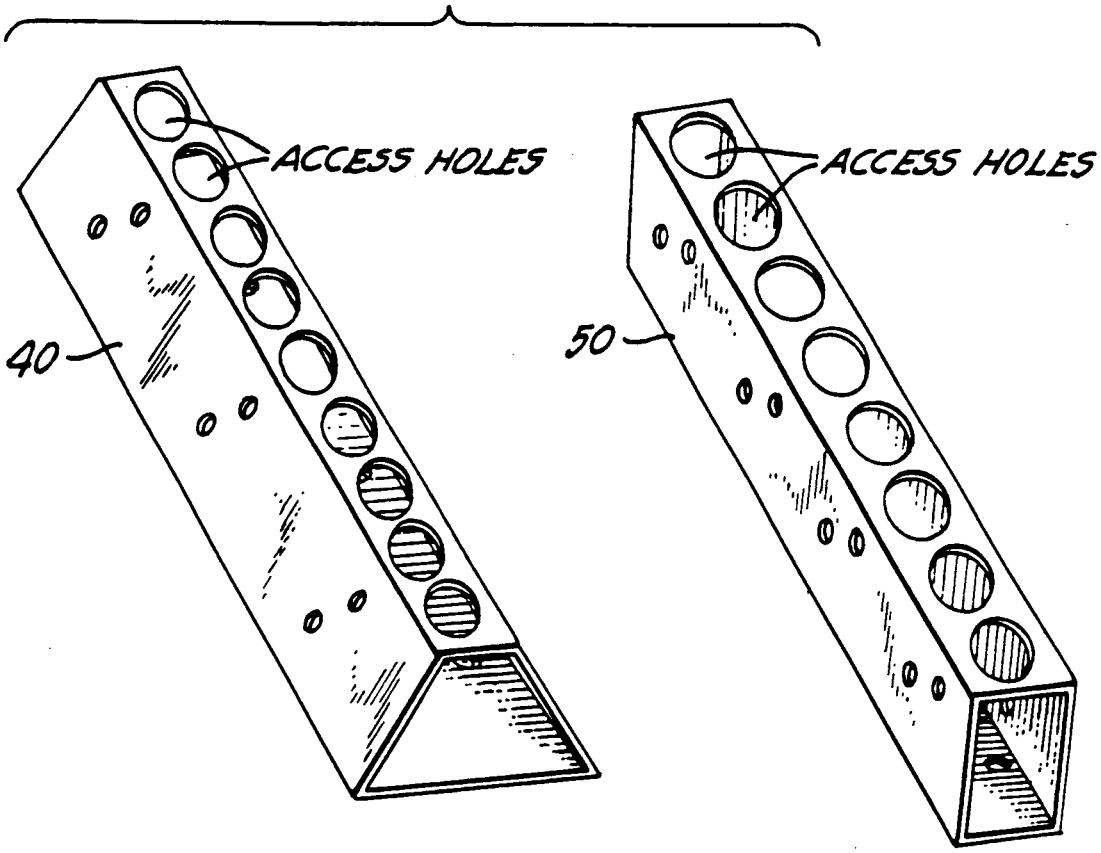
FIG. 13 provides a perspective view of two alternate form geometries for directly distributed load foundation guides.
Figure 14:
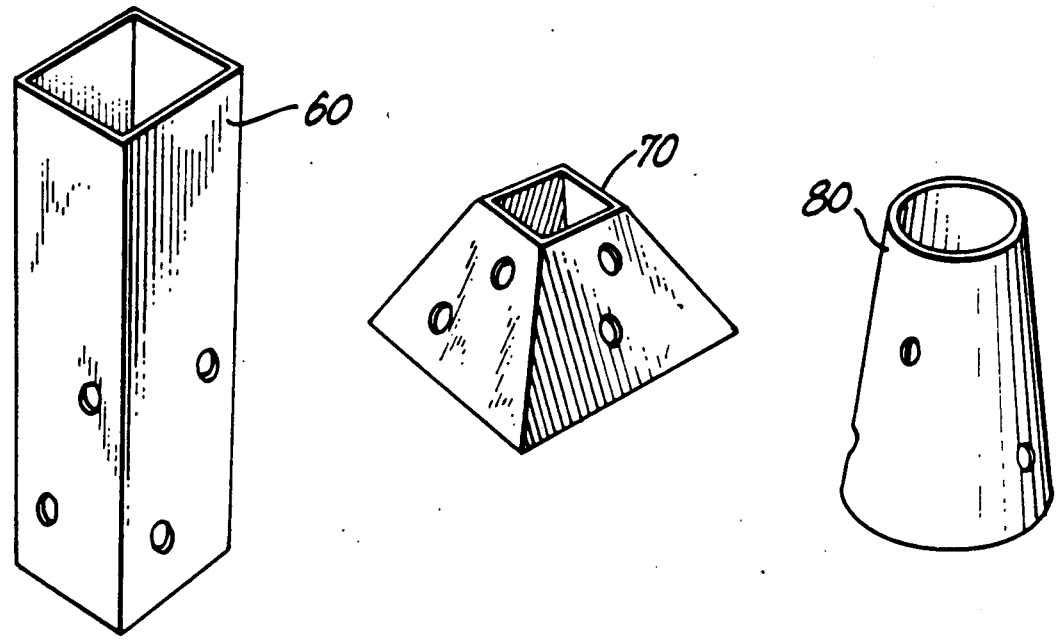
FIG. 14 provides a perspective view of three alternate form geometries for concentrated load foundation guides.

From the above, it can be appreciated that the present invention is not tied to any particular geometry for the form, and, indeed, numerous geometries may be applied consistent with the requirements of the particular construction job. In this regard, separate form structures for distributed loads are provided in FIG. 13, including form 40 (trapezoidal cross-section) and form 50 (rectangular cross-section). Similarly, in FIG. 14, three additional form geometries are provided for concentrated load bearing, consistent with the first embodiment discussed above. These include rectangular form 60, truncated pyramidal form 70, and conical form 80.

EXAMPLE

A better understanding of the benefits derived from the present invention can be obtained in the context of the following example. The construction of a one story, two-bedroom house will inevitably require the placement of a foundation to support the walls and roof. Assuming a level site, instead of excavating a typical perimeter trench roughly 18 inches deep and 24 inches wide for the pouring of (1) a footing and (2) the forming and pouring of a perimeter foundation wall to be backfilled with gravel, drain tile, additional gravel and (3) finally graded with top soil, application of the present invention involves the digging of a perimeter, spade shaped trough seven inches deep at the middle and twelve inches across at the top.

Twelve inch diameter lengths of the pinned foundation guide in FIG. 6 (cardboard form material), are laid into the trough with their open ends exposed and necessary reinforcing rods and anchor bolts are wired into place. The open ends and corners of the guide are joined and sealed with duct tape. The movable pile sleeves are tamped in place and 2 to 3 inches into the trough to fix the guide in position. One and one-half inch, inside diameter (ID) galvanized pipe piles, 54 inches long are driven at an angle of 44 degrees through the pile sleeves with a sledge hammer or pile driver, until only an inch of pile is left exposed above the protruding sleeve. This open end is capped with a plastic cap and concrete is pumped or poured into the form through the upward oriented access holes. After sufficient setting of the concrete, the cardboard form exposed above ground is removed and the concrete sill is trowel finished (if necessary) and the first framing plate for the structure is laid.

If any of the piles become fatigued (due to corrosion or for any reason), they may be replaced by new piles installed from the outside around the perimeter. Removal of the old piles may be effected by simply driving them out of the way with the new replacement piles.

It is to be understood that a guide in accordance with the present invention may have applications aside from the application specifically disclosed herein. While there has been shown and described a preferred embodiment of a guide in accordance with the invention, many changes and modifications may be made therein without, however, departing from the spirit of the invention.

I claim:

1. A guide apparatus for use in the preparation of a structure foundation by means of piles driven into a surrounding soil and secured in place in a manner to support the structure, comprising:

(a) a form means adapted to support said piles at a predetermined orientation and house a tension plate means and a cementitious material, (b) a sleeve means for receiving and directing piles into the surrounding soil at predetermined angles relative to said form means, and (c) a tension plate means for retaining said sleeve means under vertical and lateral loading at said predetermined angles, wherein said tension plate means retains at least three sleeve means each of which is disposed in a direction into the soil substantially different from the other sleeve means to permit the support of said vertical and lateral loads associated with said structure.

2. A guide according to claim 1, wherein each sleeve means is positioned relative to the form means at an angle in the approximate range of 30° to 70° from vertical.

3. A guide according to claim 1, wherein each sleeve means is positioned relative to the form means at an angle of about 45° from vertical.

4. The guide of claim 1, wherein the cementitious material is cement.

5. The guide of claim 1, wherein the tension plate means comprises a galvanized steel plate with at least three peripheral openings corresponding to the sleeve means and is dimensioned to fit inside said form means.

6. The guide of claim 1, wherein the form has a cross section that is non-circular.

7. The guide of claim 1, wherein said sleeve means extend through said form means having ends thereof external to said form means.

8. In combination in a method to provide a foundation to a structure in a soil environment wherein said foundation is to bear structure related loads, comprising the steps of:

(a) placing into said soil environment at least one foundation forming means wherein said foundation forming means comprises: a form means for establishing a predetermined orientation of plural sleeve means, and housing a cementitious material; at least three sleeve means fixedly positioned relative to said form means at pre-selected angles and adapted to receive piles driven therethrough; and a tension plate means configured to retain in fixed position said sleeve means relative to each other and restrict deformation of said cementitious materials;

(b) driving piles through said sleeve means and into said soil environment;

(c) filling said form means with said cementitious material; and (d) attaching said foundation forming means to said structure to be supported.

9. The method of claim 8, wherein said cementitious material is cement.

10. A foundation formed by the method of claim 8.

11. The method of claim 8, wherein said pre-selected angles range between 30° and 75° from vertical.

12. In combination in a foundation comprising: a form means adapted to hold plural guide sleeve means at pre-selected angles and receive a cementitious material, wherein said form means is configured as an elongated hollow body; plural tension ring means configured to fit in said form means at predetermined locations relative to said sleeve and form means; plural guide sleeve means each configured to accept and guide a corresponding pile therethrough, wherein said guide sleeve means are retained under vertical and horizontal loads in fixed position relative to said form means by said tension ring means and further at least one guide sleeve means is retained by each said tension ring means.

13. The guide of claim 12, wherein said form means is a cylindrical tube with plural access ports along a top side of said tube and plural sleeve holes along the upper and lower sides.

14. The guide of claim 12, wherein said tension ring means is constructed of galvanized steel.

15. The guide of claim 12 further comprising attachment means for joining said guide and cementitious material to a structure requiring support.

16. The guide of claim 12 further comprising reinforcing rod means in combination with said cementitious material.

17. In combination in a foundation support system comprising: a form means configured as a hollow body, adapted to house sleeves in a predetermined configuration and receive a cementitious material in fluid form for subsequent curing; at least two sleeve means configured as elongated hollow tubes, and tension bracket means for retaining under vertical and horizontal loads said sleeve means in conjunction with said cementitious material in fixed position relative to said form means, wherein said tension bracket means is configured to permit the free flow of said cementitious material throughout said form means and around said sleeve means.

18. The system of claim 17, wherein said form means is elongated and comprises plural sleeve designated positions at predetermined locations along the length thereof.

19. The system of claim 17, wherein said sleeve means are oriented in a manner that is substantially coplaner.

20. A foundation system for supporting bearing and lateral forces associated with a surface structure comprising:

(a) footing means including a cured cementitious material formed in a predetermined shape and located in a shallow excavation for coupling to said surface structure;

(b) plural sleeve guide means embedded in said cementitious material at predetermined angular relationship with said cementitious material;

(c) tension means embedded in said cementitious material for retaining the structural integrity and the relative configuration of the sleeves and piles, of said footing means under loading; and (d) pile means extending through said sleeve guide means and into subsurface a substantial distance at predetermined angles for supporting bearing and lateral forces and uplift associated with said surface structure in combination with said footing means.

21. The foundation of claim 20 wherein multiple footing means are selectively positioned to form a perimeter support structure.

22. The foundation of claim 20 wherein said footing means is an elongated horizontal rigid base secured in said shallow excavation by said pile means to support walls, beams or floors.

* * * * *